US005080513A

United States Patent [19]

Clary

[11] Patent Number: 5,080,513

[45] Date of Patent: Jan. 14, 1992

[54] PRINTER FOR FORMS AND JOURNALS

[76] Inventor: John G. Clary, 2850 Thorndike Rd., Pasadena, Calif. 91107

[21] Appl. No.: 541,550

[22] Filed: Jun. 21, 1990

[51] Int. Cl.[5] ..... B41J 11/48

[52] U.S. Cl. ..... 400/591; 400/605

[58] Field of Search ..... 400/605, 124, 64, 611, 400/607, 607.3, 608, 608.1, 608.4, 708, 591, 592, 586, 588

[56] References Cited

U.S. PATENT DOCUMENTS

| | | | |
|---|---|---|---|
| 4,229,113 | 10/1980 | Anderson et al. | 400/605 |
| 4,264,218 | 4/1981 | Okabe | 400/605 |
| 4,367,964 | 1/1983 | Cranston | 400/611 |
| 4,655,625 | 4/1987 | Brull et al. | 400/605 |
| 4,795,282 | 1/1989 | Bradam | 400/605 |
| 4,826,336 | 5/1989 | Kamimura et al. | 400/607 |
| 4,944,827 | 7/1990 | Lilly et al. | 400/605 |

FOREIGN PATENT DOCUMENTS

| | | | |
|---|---|---|---|
| 0227116 | 7/1987 | European Pat. Off. | 400/605 |
| 2717126 | 11/1978 | Fed. Rep. of Germany | 400/605 |
| 0230876 | 11/1985 | Japan | 400/605 |

*Primary Examiner*—Eugene H. Eickholt

[57] ABSTRACT

A printer for printing data on a form sheet and duplicate or related data on a journal tape in which the form sheet is fed lengthwise past a stationary ink jet printer head to print a line of characters and thereafter the print head is fed across the journal tape while the latter is stationary whereby to print a line of duplicate or related characters across the tape. Forms of different lengths can be printed.

7 Claims, 4 Drawing Sheets

PRINTER FOR FORMS AND JOURNALS

BACKGROUND OF THE INVENTION

1. Field of the Invention

This invention relates to printers and has particular reference to a printer for printing data on a form or slip and also for printing the same or related data on a journal tape.

2. Description of the Prior Art

In many business applications, duplicate or related records are made of transactions and the like. For example, in banking applications, a record form or slip is printed indicating the amount of a customer's deposit or withdrawal, etc. This is given to the customer and a record of the transaction is retained by the bank for processing and record keeping.

Although duplicate record forms may be made in one printing operation using an impact printer which prints against an inserted form that is superimposed over a journal tape with an interleaved carbon tape or with the facing surfaces of the paper chemically treated to transfer an imprint, such impact printers are noisy and, since the printing imprint must be made through the form, the quality of printing on the journal is necessarily degraded. Further, in many applications it is desirable not to print on the journal tape all of the data printed on the form. Also in many cases, it is desirable to print different but related data on the journal. This is not possible where the journal receives a carbon impression of the data printed on the form.

In the copending application of Milton V. Scozzafava and John G. Clary, SN 390,636, filed Aug. 7, 1989 now U.S. Pat. No. 4,944,620, an ink jet printer is disclosed and claimed which sequentially prints the same or related data pertaining to a transaction on separate forms or slips, one, for example, to be furnished to the customer and one to be retained by the bank for processing or record keeping. Such printer has several advantages in that it is noiseless, fast and inexpensive to manufacture. However, such printer is restricted to the use of duplicate forms or slips on which the data is printed, one to be given to the customer and the other to be retained by the bank. Thus, forms kept by the bank must be handled separately and the data recorded thereon must be later consolidated or transferred to a journal or the like.

SUMMARY OF THE INVENTION

It therefore becomes a principal object of the present invention to provide a printing system for printing data on a form and for printing the same or related data on a journal tape or the like.

Another object of the invention is to provide printing system for printing data on a form and also printing the same or related data on a journal tape without requiring interleaved carbon paper or chemically treated paper for transferring the data to the journal tape.

Another object is to provide a noiseless printing system for printing data on a form of any desired length and for printing the same or related data on a journal tape.

Another object is to provide a printer of the above type which is noiseless and capable of operating at a high speed.

A further object is to provide a simple, compact, and inexpensive high speed printer for printing data on a form and for printing the same or related data on a journal tape.

According to the invention, a printer is provided having a guide chute to receive a form on which data is to be printed. When the form is dropped into the chute, a form feeding device advances the form lengthwise of the chute and past a serially operable ink jet or the like print head which is normally maintained in a home position to print a line of data under control of a data processing system. Subsequently, the print head is advanced lengthwise of the chute from its home position and over a journal tape to print the same or a related line of print on the tape. Subsequently, the print head is returned to its home position and the journal tape is line fed relative to the chute preparatory to recording a new transaction. Forms of various lengths can be printed.

BRIEF DESCRIPTION OF THE DRAWINGS

The manner in which the above and other objects of the invention are accomplished will be readily understood on reference to the following specification when read in conjunction with the accompanying drawings, wherein.

DESCRIPTION OF THE PREFERRED EMBODIMENT

Figure 1:
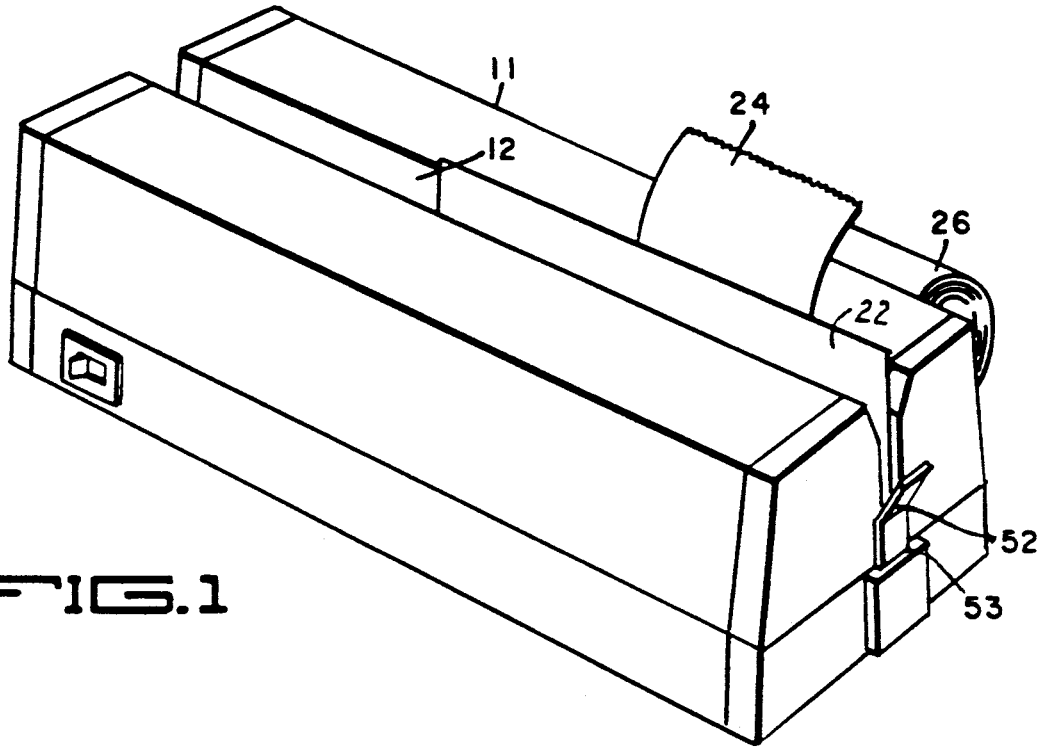
FIG. 1 is a perspective view of a printer embodying a preferred form of the present invention.

While this invention can be embodied in many different forms, there is shown in the drawings a preferred form and it should be understood that the present disclosure is to be considered only as an exemplification of the principles of the invention and is not intended to limit the invention to the embodiment illustrated. The scope of the invention will be pointed out in the appended claims.

Referring to the drawings, the printer is housed in a casing 11 (FIG. 1) having a longitudinally extending slot 12 which overlies a chute 13 (FIGS. 3 and 4) formed by coextensive forward walls 14 and 15 and coextensive rear walls 16 and 17. Walls 15 and 17 form an insertion chute section and the walls 14 and 16 form a stacking chute section.

Guide blocks 18 and 20 are mounted on a base plate 21 and serve to guide the lower edge of an inserted form, indicated by dot-dash lines 22, endwise along the chute. A guide block 23, also mounted on the base plate 21, guides the form into the stacking section of the chute.

Means are provided to feed a journal strip or tape 24 endwise through the chute and orthogonal to the direction of feeding movement of the form 22. For this purpose, a tape chute 25 is provided at the rear of the printer to receive tape 24 as it is fed off a tape roll 26. The leading edge of the tape is fed between a feed roll 27 and presser rolls 30. The latter are guided for vertical movement in a slotted support block 31 and yeildably press the tape into frictional engagement with the feed roll 27 under the action of a suitable spring 32.

The tape is led through an opening 34 in the chute wall 17 and then passes upwardly in the chute and under a tear-off bar 33.

The feed roll 27 is incrementally rotated to line feed the tape 24 upwardly in the chute by a stepper motor 35 (FIG. 3) through a gear train 36.

Figure 3:
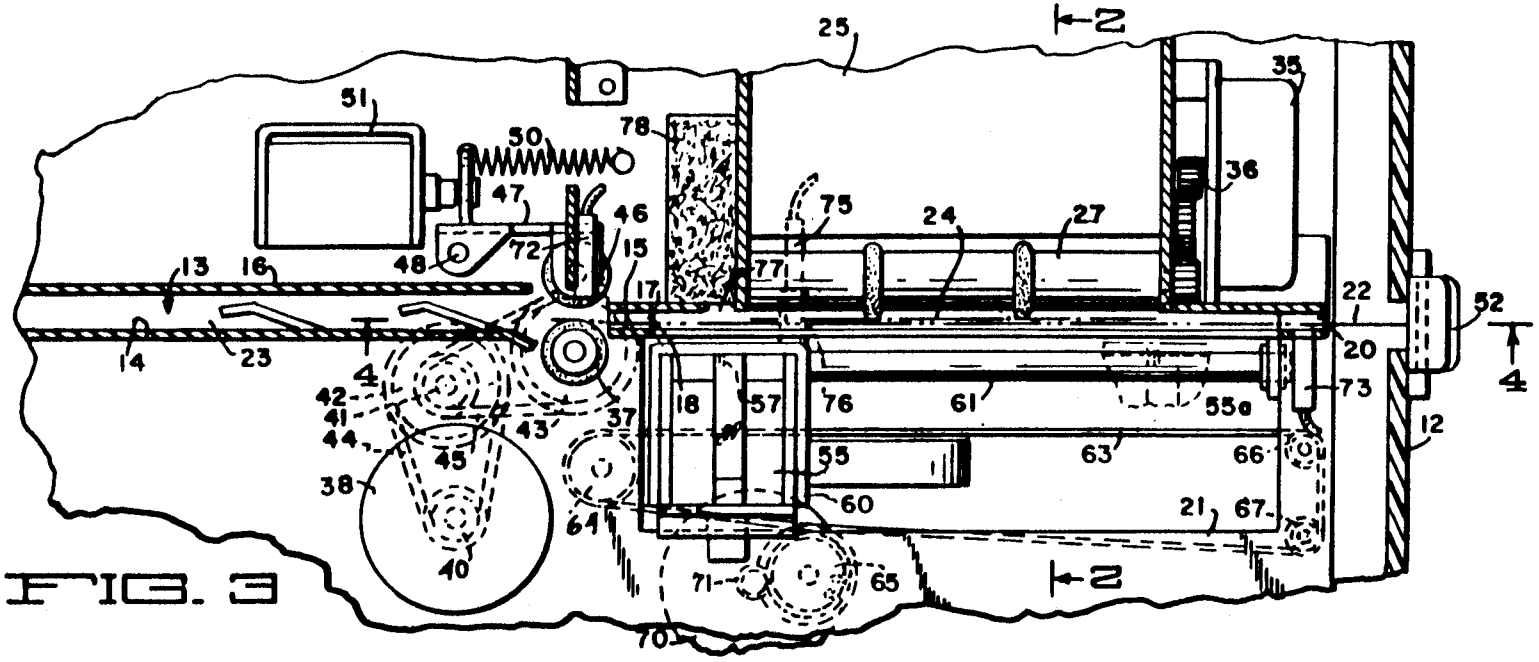
FIG. 3 is a sectional plan view taken substantially along the line 3—3 of FIG. 2.
Figure 4:
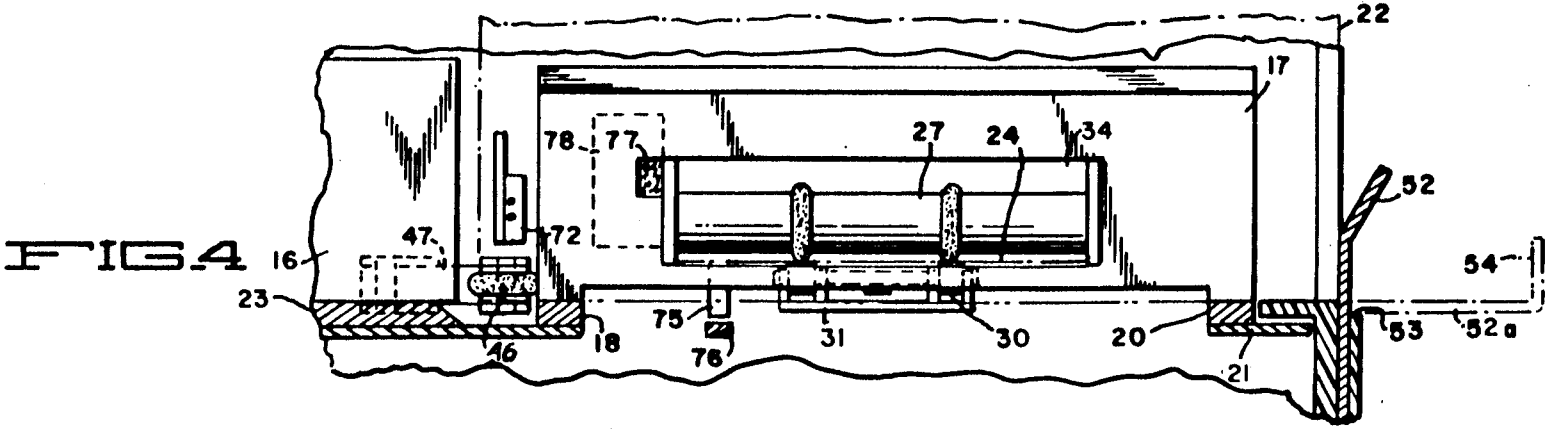
FIG. 4 is a sectional elevation view taken substantially along line 4—4 of FIG. 3.

Means are provided to advance a form 22 endwise in the chute 13 from its inserted position shown in FIG. 3 into the left hand stacking section of the chute. For this purpose, a feed roll 37 is rotatably mounted in a bearing (not shown) supported by the base plate 21 and is rotated by a uni-directional stepper motor 38 through a drive train consisting of pulleys 40, 41, 42, 43 connected by drive belts 44 and 45. A pinch roller 46 is rotatably supported by a lever 47 fulcrumed at 48 and urged clockwise by a tension spring 50. Normally, the roller 46 is held out of engagement with the feed roller or with an inserted form by a solenoid 51 whose armature is connected to the lever 47.

In order to properly locate the form 22 in the chute when inserting the same, a right hand guide piece 52 is provided to extend across the end of the chute and against which the form may be located. The piece 52 is removably fitted in a socket 53 formed in the casing. Other guide pieces, one of which is shown by dotted lines 52*a* (FIG. 4) having limit shoulders, i.e. 54, located at different distances from the end of chute 13, may be substituted for the piece 52 to accommodate forms of different lengths.

Figure 2:
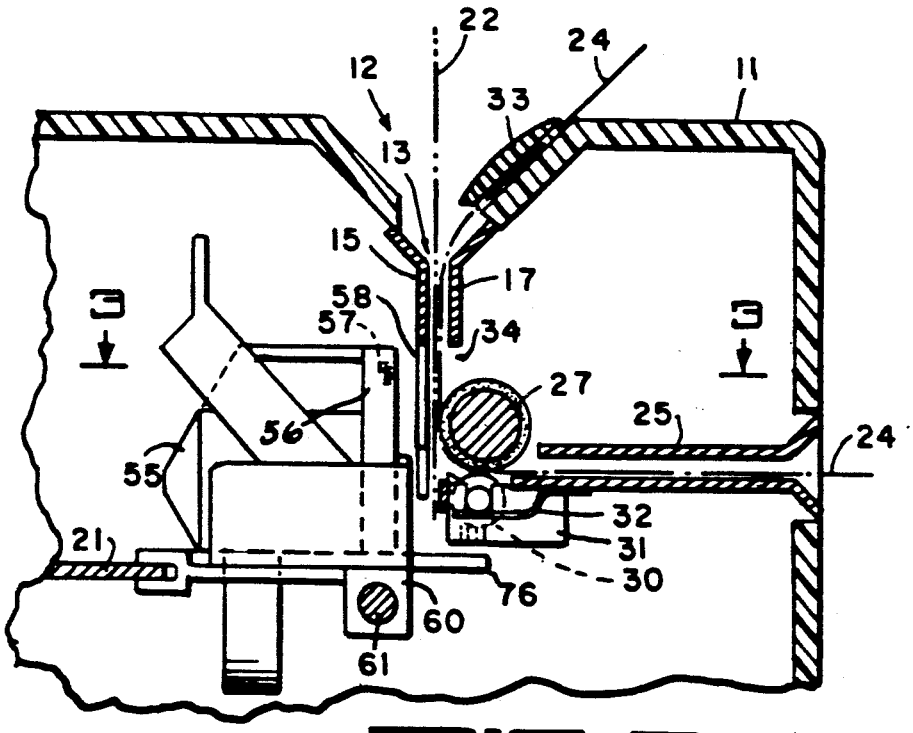
FIG. 2 is a transverse sectional view of the printer and is taken substantially along the line 2—2 of FIG. 3.

A serially operable ink jet printer head 55 (FIGS. 2 and 3) is provided to print a line of characters along the length of the form 22 as it is fed lengthwise by the feed roll 37. Such head is of conventional construction and may be obtained from the Hewlett Packard Company of Palo Alto, California as Part No. HP51604A.

The head 55 generally comprises a body having an upstanding part 56 in which are formed a plurality of vertically aligned minute ink jet nozzles 57 which can be individually controlled by a data processing system, to be described later, to impel minute globules of ink through an opening 58 in the chute wall 15 and against the form 22 or, when the latter is absent, against the tape 24.

The printer head 55 is carried by a carriage 60 which is slidably mounted on a stationary rod 61, suitably supported by brackets extending from the base plate, for movement across the tape 24. The forward portion of the carriage is slidably supported on the base plate 21.

For the purpose of advancing the carriage 55 from its initial, or home position shown in FIG. 3, it is attached to a flexible cable 63, one end of which is reeved over a pulley 64 and is attached to a capstan 65. The other end of cable 63 is reeved over pulleys 66 and 67 and is also attached to the capstan 65.

A bi-directional stepper motor 70 is connected by gearing 71 to the capstan 65 to advance the printer head 55 in either direction to and from its home position.

When the print head 55 is in its home position, the ink jet nozzles 57 are aligned with an opening 77 in the wall 17, behind which is a pad 7B of ink absorbent material which forms an ink receptacle.

Figure 5:
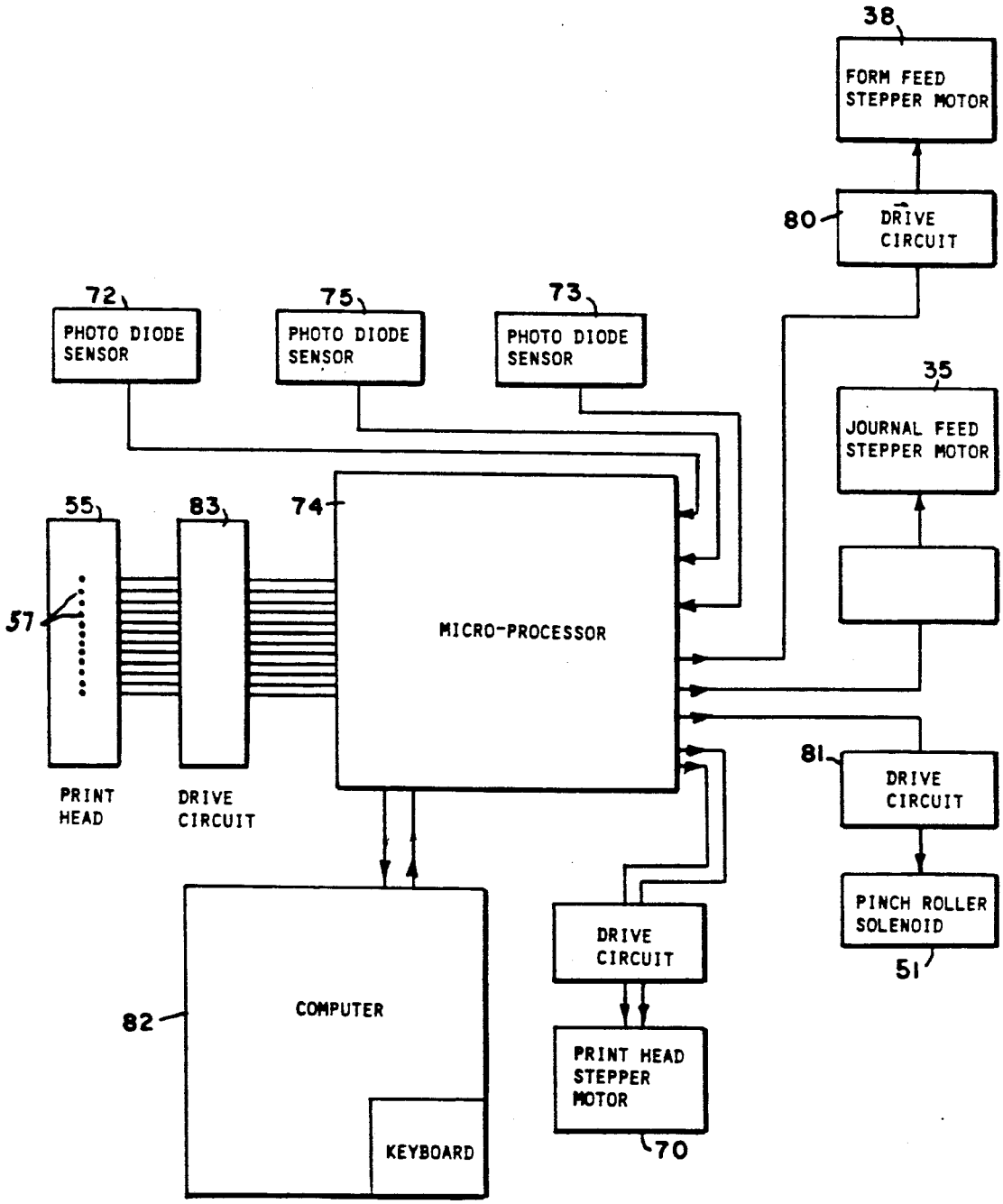
FIG. 5 is a block diagram of the controls for the printer.

A pair of conventional light sensing devices 72 and 73, such as photo diodes, are stationarily mounted adjacent opposite ends of the chute walls 15 and 17 to sense the location of a form in the chute and to transmit signals to a microprocessor 74 (FIG. 5).

A third light sensing device 75 is mounted in the path of a tab 76 on the printer head carriage 60 to transmit a signal to the microprocessor 74 when the printer head is in or out of home position.

OPERATION

When a form 22 which may, for example, be a bank deposit or withdrawal slip or a check to be validated, is dropped into the insertion section of the chute 13, it passes in front of the journal tape 24 and activates the sensors 72 and 73. These signal the microprocessor 74 to apply a signal to a drive circuit 80 to energize the form feed motor 38. A signal is also applied to a drive circuit 81 to deenergize the pinch roller solenoid 51, enabling the motor 38 to advance the form past the printer head 55. During such traverse, data from a computer 82, which may be a standard electronic computer, such as an IBM PC model, is fed through the microprocessor 74 and thence to a drive circuit 83 which energizes the ink jet nozzles in proper order to print a line of readable characters on the form.

After a predetermined time and as form 22 passes beyond the sensor 72 a signal is transmitted thereby to deenergize the form feed motor 38 and to energize the printer head motor 70, causing the print head to advance to the right. During this movement duplicate or related data from the computer 82 is again fed through the microprocessor to appropriately energize the ink jet nozzles 57 and thus form a line of characters across the tape 24.

When the print head reaches its right hand margin position indicated partly by dotted lines 55*a*, and as determined, for example, by the microprocessor in counting the number of character spaces being printed across the tape 24, the motor 70 is reversed to return the print head 55 to its home or left hand margin position. During such return movement, the microprocessor 74 applies a signal to energize the journal feed motor 35 to line feed the journal tape one increment. It also applies a signal to again energize the pinch roller solenoid 51 to release the pinch roller to enable a new form 22 to be dropped into the chute 13.

At any time when the printer head 55 is in its home position, the computer may be activated to cause all of the ink jet nozzles to direct streams of ink into the receptacle or pad 78 to clean the nozzles and thus prevent clogging of the nozzle with dried ink.

Figure 6:
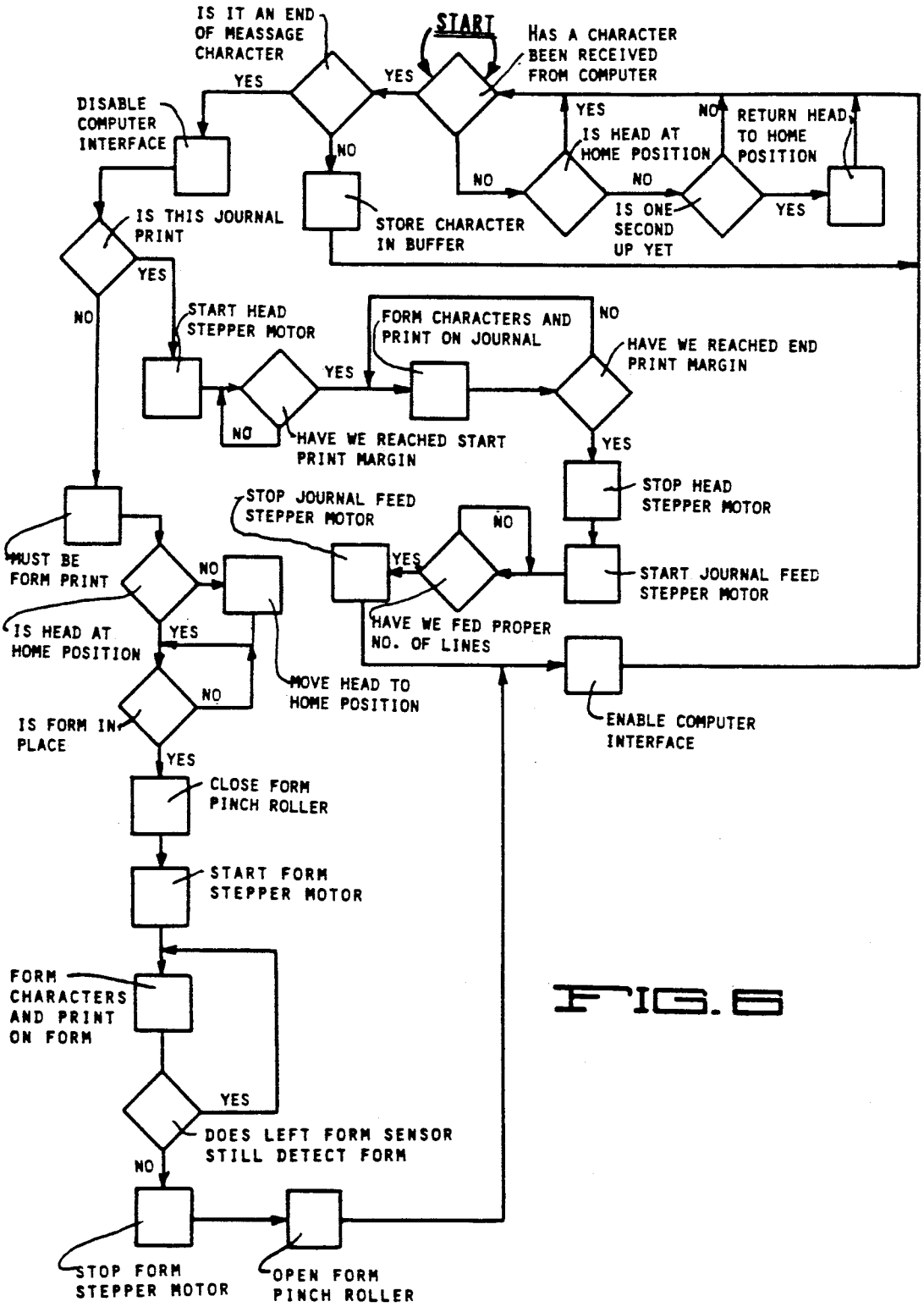
FIG. 6 is a logic flow diagram of the printer controls.

FIG. 6 illustrates a logic flow diagram showing the steps followed in controlling the various components of the system.

From the foregoing it will be seen that I have provided an extremely simple, compact, inexpensive and noiseless ink jet printer for printing a line of data on a form sheet and, in the same operation, printing duplicate or related data on a journal sheet, using the same print head. Also, form sheets of different lengths may be printed. Further, if desired, the printer can be utilized to print only on a form sheet or only on a journal sheet.

I claim:

1. A printer for printing data on a form sheet and on a journal strip comprising an elongate sheet guide chute, a printing device adjacent said chute for serially printing characters, means for maintaining said printing device in an initial position, first means for moving said form sheet along said chute whereby to print a line of characters on said sheet, means supporting at least a portion of said strip in said chute, means for sensing movement of said sheet by a predetermined amount in said chute, and means responsive to said sensing means for causing said printing device to move out of said initial position and along said strip whereby to print a line of characters on said strip.

2. A printer as defined in claim 1 comprising means responsive to movement of said printing device to a predetermined position along said strip for returning said printing device to said initial position.

3. A printer as defined in claim 2 comprising means responsive to movement of said printing device to a predetermined position along said strip for line feeding said strip past said guide chute in a direction orthogonal to the length of said chute.

4. A printer as defined in claim 1 wherein said printing device comprises an ink jet head for impelling ink toward said chute, and means forming an ink receptacle, said receptacle being located to receive ink from said print head when said head is in said initial position.

5. A printer for printing data on a pair of record mediums comprising a printing device for serially printing characters, means for maintaining said device in an initial position, first drive means for moving a first one of said mediums past said device and along a printing line whereby to print a line of characters on said one medium, and a second drive device for thereafter moving said device from said initial position and past the second one of said mediums along said printing line whereby to print a second line of characters on said second medium.

6. A printer as defined in claim 5 comprising a guide chute for guiding said first medium for movement in a first plane extending along said printing line, and a device for supporting at least part of said second medium in a second plane adjacent and parallel to said first plane.

7. A printer as defined in claim 5 comprising means for sensing movement of said first medium past said printing device, and means controlled by said sensing device for causing operation of said second drive means.

* * * * *